US005632285A

United States Patent [19]

Dahlgrün

[11] Patent Number: 5,632,285

[45] Date of Patent: May 27, 1997

[54] APPARATUS FOR MAKING FILTER TIPPED SMOKERS' PRODUCTS HAVING A NON-CIRCULAR CROSS-SECTIONAL OUTLINE

[75] Inventor: Rolf Dahlgrün, Chaville, France

[73] Assignee: Decouflé S.A.R.L., Chilly-Mazarin, France

[21] Appl. No.: 607,451

[22] Filed: Feb. 27, 1996

[30] Foreign Application Priority Data

Mar. 3, 1995 [DE] Germany ..... 195 07 395.9

[51] Int. Cl.[6] ..... A24C 5/10; A24C 5/47

[52] U.S. Cl. ..... 131/94; 131/27.1; 131/29

[58] Field of Search ..... 131/280, 94, 27.1, 131/29, 58, 61.1

[56] References Cited

U.S. PATENT DOCUMENTS

| | | | |
|---|---|---|---|
| 3,583,546 | 6/1971 | Koop . | |
| 3,625,103 | 12/1971 | Giatti . | |
| 4,535,790 | 8/1985 | Wheless | 131/94 |
| 4,969,551 | 11/1990 | Heitmann et al. . | |
| 5,135,008 | 8/1992 | Oesterling et al. . | |

FOREIGN PATENT DOCUMENTS

| | | | |
|---|---|---|---|
| 0124289 | 8/1987 | European Pat. Off. . | |
| 0231565 | 8/1987 | European Pat. Off. . | |
| 2504772 | 8/1975 | Germany | 131/29 |

*Primary Examiner*—Jennifer Bahr

*Attorney, Agent, or Firm*—Darby & Darby

[57] ABSTRACT

Adherent uniting bands are wound around adjacent end portions of successive groups of plain cigarettes and filter mouthpieces having elliptical cross-sectional outlines while the groups are transported sideways through a passage between a rotary conveyor and a stationary rolling member. The peripheral rolling surface of the conveyor has an undulate profile conforming to the outlines of the articles forming the groups and such surface is provided with axially parallel flutes wherein the groups are received during advancement toward the passage. The rolling member has a second rolling surface confronting the peripheral rolling surface across the passage and having a second undulate profile also conforming to the outlines of the articles forming the groups. Successive groups approaching the inlet of the passage are caused to leave their flutes and to roll between the two surfaces during advancement through the passage to thus convolute the uniting bands around the adjacent end portions of the respecive articles. The rolling surfaces cause the axes of the rolling groups to advance in the passage along an arcuate path having its center of curvature on the axis of rotation of the conveyor.

9 Claims, 3 Drawing Sheets

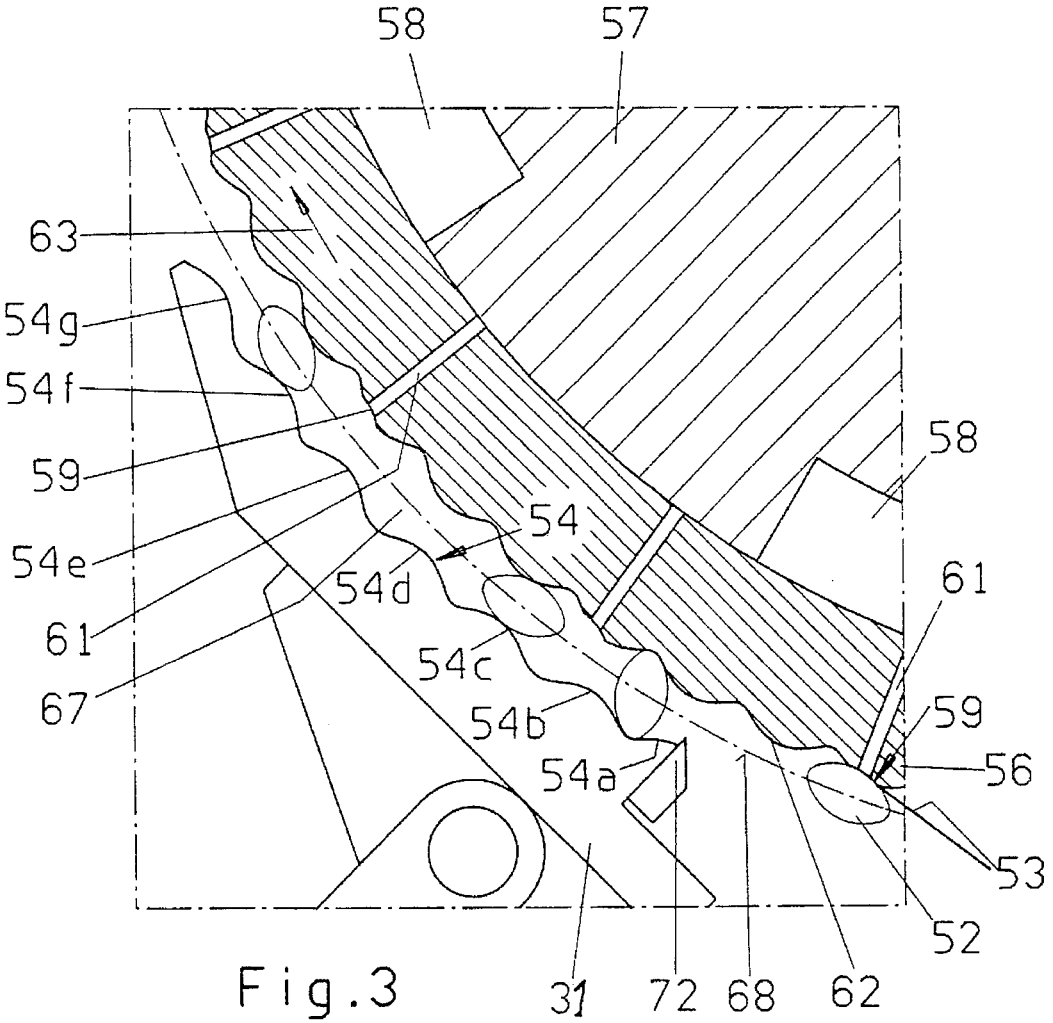
Fig.3
Fig.4
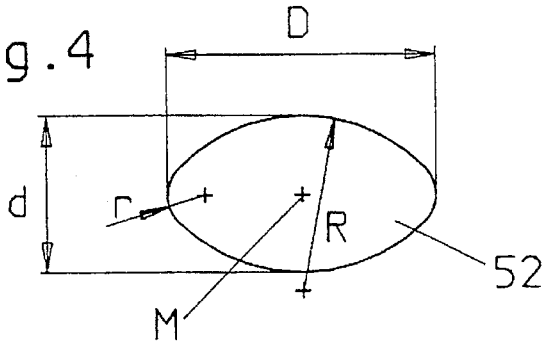

APPARATUS FOR MAKING FILTER TIPPED SMOKERS' PRODUCTS HAVING A NON-CIRCULAR CROSS-SECTIONAL OUTLINE

BACKGROUND OF THE INVENTION

The invention relates to improvements in apparatus for making smokers' products of the type wherein two or more rod-shaped sections or components are disposed end-to-end and are secured to each other by adherent uniting bands. Typical examples of such smokers' products are filter cigarettes wherein a tobacco-containing rod-shaped section is united with a rod-shaped mouthpiece by a band of tipping paper which is wound around the abutting end portions of the tobacco-containing section and the mouthpiece.

More particularly, the invention relates to improvements in apparatus for making rod-shaped smokers' products, such as filter cigarettes, having a non-circular (normally elliptical) cross-sectional outline. The following description will deal primarily with the making of filter cigarettes; however, it is to be understood that the improved apparatus can be utilized with equal or similar advantage for the making of filter cigarillos, filter cigars and/or other filter tipped rod-shaped smokers' products.

Filter cigarettes having a circular cross-sectional outline are normally produced in so-called filter tipping machines (e.g., in production lines known as PROTOS 2, PROTOS 70, PROTOS 90 and PROTOS 100, all produced and distributed by the assignee of the present application) wherein groups normally containing two coaxial plain cigarettes of unit length and a filter mouthpiece of double unit length between them, and each carrying an adhesive-coated uniting band, are caused to advance through a passage between a drum shaped rolling conveyor and a stationary rolling member. The groups, which are partially confined in axially parallel peripheral flutes of the conveyor, are caused to roll about their respective axes during advancement through the passage whereby the uniting bands are draped around the respective filter mouthpieces of double unit length and the neighboring end portions of the respective plain cigarettes of unit length so that each group is converted into a filter cigarette of double unit length. Such filter cigarettes of double unit length are thereupon severed midway across their convoluted tubular uniting bands to yield pairs of filter cigarettes of unit length. Reference may be had, for example, to commonly owned U.S. Pat. Nos. 4,969,551 and 5,135,008 the disclosures of which should be considered as being incorporated into this specification. Apparatus of the just outlined character are utilized to turn out trillions of round filter cigarettes per annum.

The method of and the apparatus for the making of round filter cigarettes cannot be utilized for the making of filter cigarettes having non-circular (particularly elliptical) cross-sectional outlines. The reason is that an article having a non-circular cross-sectional outline will not roll through a passage or channel between a rigid drum-shaped conveyor and a rigid stationary rolling member. On the other hand, there is a considerable demand for filter cigarettes and other filter tipped rod-shaped smokers' products having an elliptical or other non-circular cross-sectional outline. Heretofore known proposals to mass-produce filter cigarettes having non-circular cross-sectional outlines involve the replacement of the rigid stationary rolling member with a flexible belt or band which is driven in the direction of advancement of groups of axially aligned rod-shaped articles having a non-circular cross-sectional outline and moves at a speed less than the speed of the fluted drum-shaped conveyor which advances groups of articles toward and into the passage. The groups of articles which enter the passage are caused to roll relative to the periphery of the fluted conveyor and relative to the adjacent surface of the belt or band whereby the configuration of the belt or band varies in response to rolling of the groups during advancement through the passage. Reference may be had, for example, to European patent No. 0 124 289 B1 which discloses a machine for the making of filter cigarettes having a non-circular cross-sectional outline by resorting to a fluted rotary drum-shaped conveyor and a flexible belt or band as a means for convoluting the uniting bands around the filter mouthpieces and the adjacent end portions of the respective plain cigarettes. A drawback of the apparatus which is disclosed in the European patent is that the pressure upon the groups which are in the process of rolling through the passage between the rigid drum-shaped conveyor and the yieldable belt or band varies within a wide range during each revolution of the articles. This exerts an adverse influence upon the appearance and/or other desirable characteristics of the thus obtained smokers' products.

OBJECTS OF THE INVENTION

An object of the invention is to provide an apparatus which can turn out rod-shaped smokers' products having a non-circular cross-sectional outline in such a way that the quality of the ultimate products is not inferior to that of smokers' products having a circular cross-sectional outline.

Another object of the invention is to provide an apparatus which can turn out rod-shaped smokers' products having a non-circular cross-sectional outline at the same rate per unit of time as an apparatus for the making of smokers' products having a circular cross-sectional outline.

A further object of the invention is to provide a novel and improved combination of parts which define the passage or channel for rolling adherent uniting bands around groups of aligned coaxial rod-shaped articles having an elliptical or other non-circular cross-sectional outline.

An additional object of the invention is to provide a novel and improved filter tipping machine or production line.

Still another object of the invention is to provide a novel and improved rotary conveyor and a novel and improved rolling member for use in the above outlined apparatus for the making of filter cigarettes or other filter-tipped rod-shaped smokers' products having a non-circular cross-sectional outline, such as an elliptical cross-sectional outline.

A further object of the invention is to provide a novel and improved mechanism for convoluting adherent (such as adhesive-coated) uniting bands around groups of aligned coaxial rod-shaped articles forming part of smokers' products and having a non-circular cross-sectional outline.

Another object of the invention is to provide a novel and improved method of making filter cigarettes having an elliptical or other non-circular cross-sectional outline.

An additional object of the invention is to provide a novel and improved method of making filter cigarettes or analogous smokers' products having a non-circular cross-sectional outline in such a way that the draping of adherent uniting bands around the neighboring end portions of articles forming the groups does not affect the quality of the ultimate products.

Still another object of the invention is to provide a novel and improved method of converting groups of aligned coaxial rod-shaped articles having a non-circular cross-sectional outline into filter cigarettes or analogous smokers' products of unit or multiple unit length.

SUMMARY OF THE INVENTION

One feature of the invention resides in the provision of an apparatus for connecting groups of aligned rod-shaped smokers' articles, which articles have non-circular cross-sectional outlines and include neighboring end portions, by adherent (e.g., adhesive coated) uniting bands which can be made of paper or the like and are carried by and are to be convoluted around the neighboring end portions of the articles. The improved apparatus comprises a group advancing conveyor which is rotatable in a predetermined direction about a predetermined axis and has a peripheral surface provided with axially parallel group-receiving flutes or receptacles. The peripheral surface of the conveyor has a first undulate profile which conforms to the outlines of the articles forming the groups, and the apparatus further comprises a rolling member (e.g., a stationary substantially strip-shaped rolling member) which is adjacent to and defines with the conveyor a passage wherein the uniting bands carried by the oncoming groups are convoluted about the end portions of the respective articles as a result of rolling of the articles along the peripheral surface. The rolling element has a second rolling surface which confronts the peripheral rolling surface of the conveyor across the passage and has a second undulate profile also conforming to the outlines of the articles forming the groups. The two surfaces can include portions having substantially elliptical profiles.

The axes of the groups of articles which are being advanced by the conveyor are at least substantially parallel to the (predetermined) axis of rotation of the conveyor, and the profiles of the two surfaces can be such that the axes of the groups being advanced through the passage move along an arcuate path having a center of curvature on or at the predetermined axis.

If one disregards the fact that the peripheral surface of the conveyor is a substantially convex surface and that the second rolling surface is a substantially concave surface, the two surfaces can be said to be substantial mirror images of each other with reference to a plane which halves the passage and is disposed between the two surfaces.

At least the second surface (i.e., the rolling surface of the rolling member) preferably includes a plurality of sections which follow each other (as seen in the direction of rotation of the conveyor) and have at least substantially identical portions of the second profile. For example, the second rolling surface can include at least three such sections.

The passage has an inlet and an outlet (as seen in the direction of rotation of the conveyor), and the apparatus can further comprise a group contacting member (e.g., in the form of an elongated strip) which is disposed at the inlet of the passage and extends toward but short of the peripheral rolling surface of the conveyor to set in rolling motion (relative to the peripheral rolling surface) the groups of articles being received in the oncoming flutes and being advanced toward the passage. The group contacting member is or can be stationary and preferably extends substantially radially of as well as in substantial parallelism with the axis of the conveyor. A ridge or tip of the group contacting member can serve as a means for aligning successive groups with the axis of the conveyor not later than upon entry of the groups into the passage by way of the inlet.

The novel features which are considered as characteristic of the invention are set forth in particular in the appended claims. The improved apparatus itself, however, both as to its construction and the mode of installing and utilizing the same, together with additional features and advantages thereof, will be best understood upon perusal of the following detailed description of certain presently preferred specific embodiments with reference to the accompanying drawings.

BRIEF DESCRIPTION OF THE DRAWINGS

FIG. 3 is a greatly enlarged view of a detail within the phantom-line square III in FIG. 2; and FIG. 4 is an end elevational view of a group of aligned smokers' products which can be rolled in the apparatus including the structure shown in FIGS. 2 and 3.

DESCRIPTION OF PREFERRED EMBODIMENTS

Figure 1:
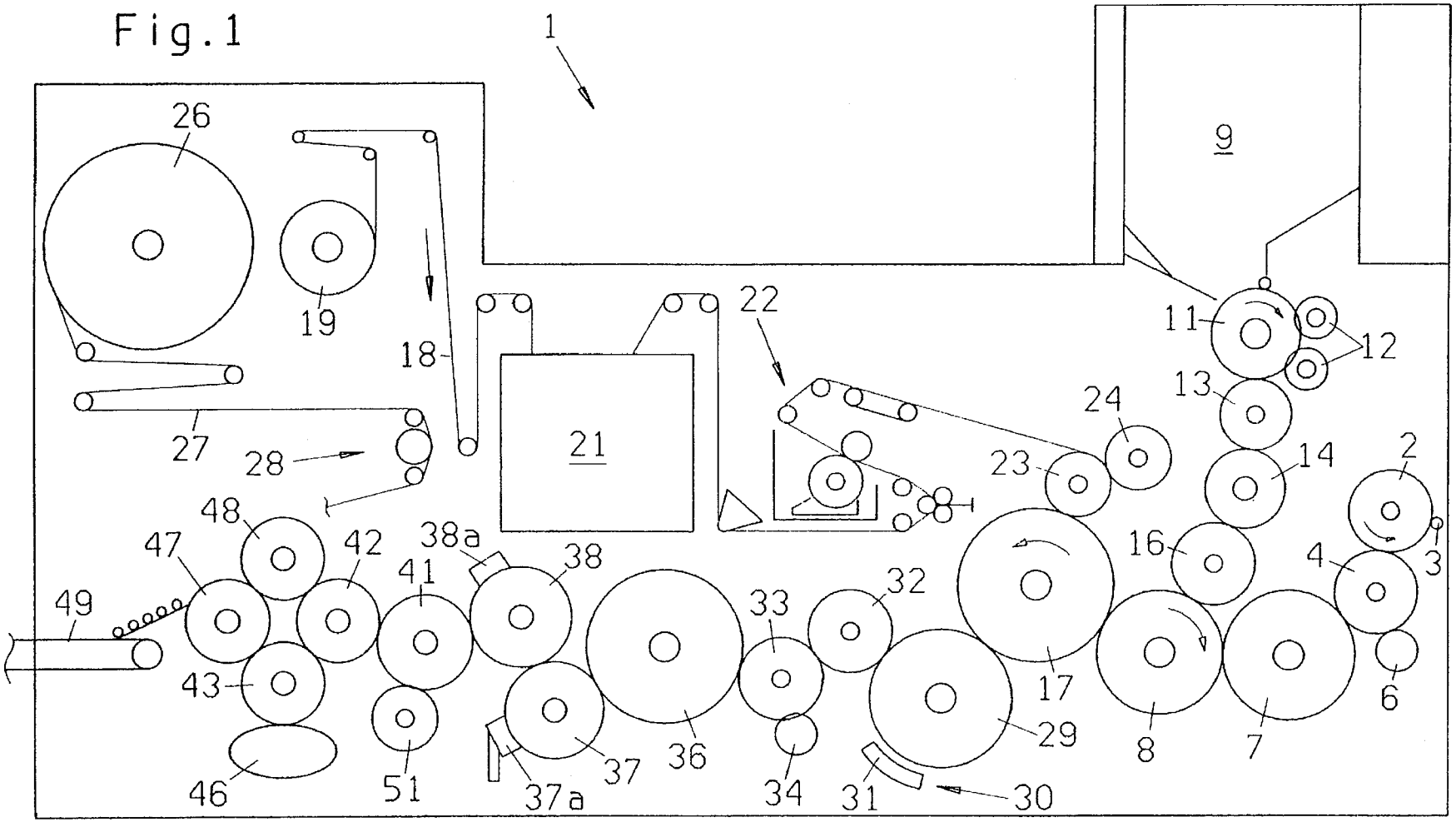
FIG. 1 is a diagrammatic front elevational view of a filter tipping machine utilizing an apparatus which embodies one form of the present invention.

FIG. 1 shows a filter tipping machine 1 which, in many respects, is identical with or analogous to those disclosed in the aforementioned commonly owned U.S. Pat. Nos. 4,969,551 and 5,135,008. This machine comprises a rotary drum-shaped conveyor 2 which has axially parallel peripheral flutes for reception and transport of plain cigarettes 3 of double unit length. For example, the illustrated machine can resemble a filter assembler which is known as MAX 90 (produced and distributed by the assignee of the present application), and the machine which supplies plain cigarettes 3 to the conveyor 2 can constitute a rod maker known as SE 90 (also produced and distributed by the assignee of the present application).

The conveyor 2 delivers cigarettes 3 of double unit length into successive flutes of a rotary drum-shaped severing conveyor 4 which cooperates with a rotary disc-shaped knife 6 to sever successive cigarettes 3 midway between their ends so that each cigarette 3 yields two coaxial plain cigarettes of unit length. The cigarettes of each pair of cigarettes of unit length are transferred onto a further rotary drum-shaped conveyor 7 to be moved axially of and away from each other in order to establish gaps having a width at least matching the length of a filter mouthpiece of double unit length. This can be achieved mechanically (e.g., by resorting to a wedge) and/or pneumatically (e.g., by pushing or pulling the plain cigarettes of each pair axially and away from each other).

The conveyor 7 delivers pairs of axially spaced-apart plain cigarettes of unit length into successive axially parallel peripheral flutes of a rotary assembly conveyor 8 which further receives filter mouthpieces of double unit length from a rotary drum-shaped inserting and accelerating conveyor 16 in such a way that each filter mouthpiece is received in the gap between a pair of axially spaced apart plain cigarettes of unit length. This results in the formation of successive groups each of which comprises three axially aligned components, namely two plain cigarettes of unit length and a filter mouthpiece of double unit length between them. The components of each group (such groups are shown at 52 in each of FIGS. 2, 3 and 4) have non-circular cross-sectional outlines. In the illustrated embodiment, the components of the groups 52 have elliptical cross-sectional outlines.

Filter mouthpieces of six times unit length are temporarily stored in a magazine 9 carried by the frame or or housing of a filter cigarette making machine including the filter assembler of FIG. 1. Such filter mouthpieces can be supplied by a filter rod production line known as AF2/KDF2 or AF3E/KDF3E (both produced and distributed by the assignee of the present application). The outlet of the magazine 9 admits filter rod sections of six times unit length into the flutes of a rotary drum-shaped severing conveyor 11 which cooperates with two axially and circumferentially staggered rotary disc-shaped knives 12 to subdivide each filter rod section of six times unit length into three coaxial filter rod sections of double unit length. The conveyor 11 delivers the sets of three coaxial filter rod sections of double unit length onto a staggering conveyor 13 which shifts the filter mouthpieces of each set in the circumferential direction and delivers the thus shifted filter mouthpieces of double unit length into successive axially parallel peripheral flutes of a rotary drum-shaped shuffling conveyor 14 serving to convert the thus received filter rod sections into a single file wherein the sections are parallel to and are located behind each other with their end faces disposed in two planes which are normal to the axis of the conveyor 14. The latter delivers successive filter rod sections of the single file into successive axially parallel peripheral flutes of the aforementioned combined accelerating and inserting conveyor 16 which, in turn, delivers successive filter rod sections of double unit length into the gaps between the pairs of coaxial plain cigarettes of unit length in successive flutes of the assembly conveyor 8.

The thus obtained groups 52 in the flutes of the assembly conveyor 8 are condensed (e.g., by causing the free end portions of the two plain cigarettes of each group to advance past a ramp or a like axially shifting device in order to eliminate clearances (if any) between the plain cigarettes and the adjacent end portions of the respective filter rod section of double unit length) so that each of the thus treated groups consists of three elongated components wherein the end faces of the filter rod section abut the adjacent end faces of the respective plain cigarettes of unit length.

The housing of the filter assembler which is shown in FIG. 1 further carries an expiring reel 19 of convoluted wrapping material 18 which is called tipping paper and forms a web advancing along an elongated path first through a perforating unit 21 and thereupon through an adhesive applying unit or paster 22 which coats at least a portion of one side of the running web with a suitable adhesive. The purpose of the perforating unit 21 is provide selected portions of the running web 18 with so-called ventilating holes serving to admit cool atmospheric air into the column of hot tobacco smoke flowing from the lighted end of a filter cigarette into the smoker's mouth. The leader of the web 18 is attracted by suction to the periphery of a continuously driven severing or subdividing conveyor 23 which cooperates with circumferentially spaced apart knives on a rotary knife carrier 24 so that the leader of the web 18 is repeatedly severed by such knives and yields a file of discrete uniting bands which are attached to the filter rod sections of successive groups 52 in the flutes of a transfer conveyor 17 which receives such groups from the assembly conveyor 8.

The expiring reel 19 is adjacent to a fresh reel 26 containing a supply of convoluted web 27 having a leader located at a splicing station 28. The latter comprises means (well known in the relevant art) for automatically attaching the leader of the fresh web 27 to the trailing end portion of the web 18 when the supply of web 18 on the reel 19 is about to expire.

Positioning of the perforating unit 21 adjacent or in the path of advancement of the running web 18 is optional. Such unit can be replaced with a perforating unit which cooperates with a selected conveyor of the filter assembler (e.g., with a rotary drum-shaped conveyor 32 downstream of the improved apparatus which forms part of the filter assembler and serves to convolute discrete uniting bands around the respective filter rod sections of double unit length as well as around the adjacent end portions of the respective plain cigarettes of unit length in order to convert each group 52 into a filter cigarette 71 (see FIG. 2) of double unit length). The improved apparatus is shown at 30 and comprises a drum-shaped advancing conveyor 29 having axially parallel peripheral group-receiving flutes 59 (FIG. 3), and a stationary (but preferably adjustable) rolling member 31.

Filter cigarettes 71 of double unit length which advance beyond the rolling member 31 of the apparatus 30 are accepted by the aforementioned intermediate conveyor 32 (which can cooperate with a perforating unit replacing the perforating unit 21) serving to deliver successive cigarettes 71 into the flutes of a rotary drum-shaped severing or subdividing conveyor 33 cooperating with a rotary disc-shaped knife 34 to divide each cigarette 71 into two coaxial filter cigarettes of unit length. The thus obtained pairs of filter cigarettes of unit length are transferred onto a spreading conveyor 36 performing a function similar to that of the conveyor 7, namely to move at least one filter cigarette of each pair axially and away from the other filter cigarette of the respective pair. The thus treated pairs of filter cigarettes of unit length are transferred onto a first testing conveyor 37 which cooperates with a first testing device **37*a*. The once tested filter cigarettes are transferred onto a second testing conveyor 38 cooperating with a second testing device 38*a*. The testing devices 37*a*, 38*a* can ascertain the quality of the wrappers of the filter cigarettes, the degree of ventilation achievable with the perforations formed by the unit 21, the so-called draw resistance, the presence or absence of blemishes on the wrappers, the presence or absence of frayed ends of the wrappers, the density of the tobacco-containing ends and/or other desirable or important parameters. Signals from the testing devices 37*a*, 38*a*** are transmitted to a standard control unit which can initiate segregation or ejection of defective cigarettes and/or can inform the operators of the presence of defective filter cigarettes and/or can initiate certain undertakings to interrupt the making of defective filter cigarettes. Such testing units and the control units therefor are well known in the art of making filter cigarettes.

The testing conveyor 38 delivers two rows of filter cigarettes of unit length into successive flutes of a rotary drum-shaped intermediate conveyor 41 which, in turn, can deliver defective cigarettes (namely those found to be defective by the testing unit **37*a* and/or 38*a*) to an evacuating or ejecting conveyor 51. Satisfactory filter cigarettes are advanced from the conveyor 41 onto a transfer conveyor 42 forming part of a turn-around device which further includes rotary drum-shaped conveyors 43, 48, 47 as well as a conical inverter 46. The turn-around device is or can be similar to or identical with that disclosed in U.S. Pat. No. 3,625,103 the disclosure of which is also incorporated herein by reference. The purpose of the turn around device is to invert one filter cigarette of each pair of axially aligned cigarettes end-for-end and to place it into gaps between neighboring non-inverted filter cigarettes so that the filter cigarettes reaching a take-off belt conveyor 49 form a single file or row of filter cigarettes of unit length having their filter mouthpieces (of unit length) facing in the same direction. The non-inverted filter cigarettes advance from the conveyor 42 onto the conveyor 48 and thence onto the conveyor 47. The cigarettes of the other row are transferred from the conveyor 42 onto the conveyor 43, are then inverted end-for-end by the conical inverter 46 and returned onto the conveyor 43 to be thereupon advanced onto the conveyor 47, namely into alternate flutes at the periphery of the conveyor 47; the other flutes of the conveyor 47 receive non-inverted cigarettes from the conveyor 48**.

The single row of filter cigarettes (with their filter mouthpieces facing in the same direction) reaching the upper reach of the conveyor 49 is advanced into storage or directly into a further processing machine (e.g., into a cigarette packing machine, not shown), preferably by way of a so-called mass flow conveyor which can advance a stream or flow of cigarettes in the form of several superimposed layers to one or more packing or other processing machines for filter cigarettes of unit length.

Another turn-around device which can be utilized in the assembler of FIG. 1 in lieu of the device including the parts 42, 43, 46, 47 and 48 is disclosed in U.S. Pat. No. 3,583,546.

Figure 2:
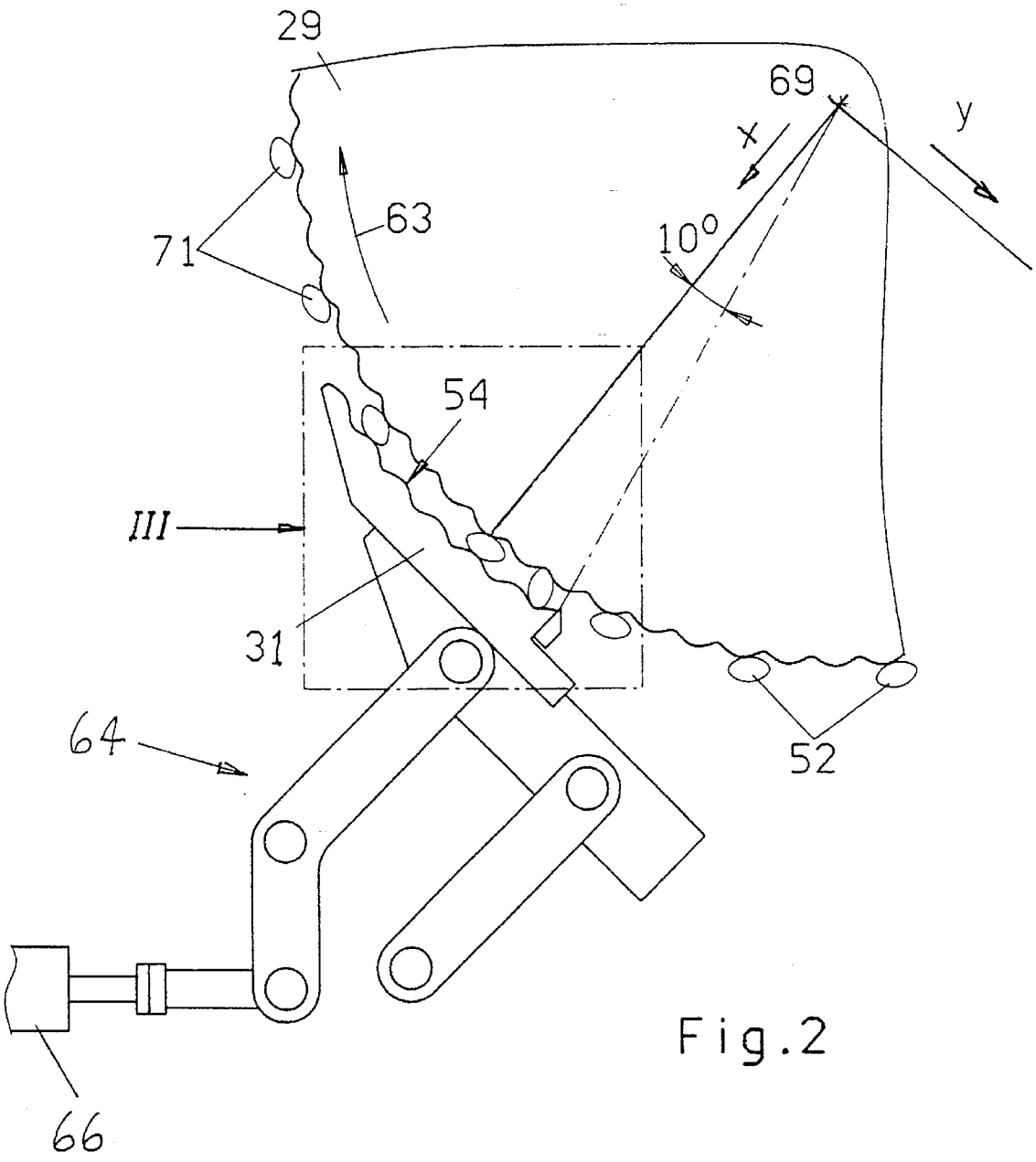
FIG. 2 is an enlarged fragmentary front elevational view of the apparatus.

The details of a presently preferred embodiment of the apparatus 30 including the fluted group advancing conveyor 29 and the rolling member 31 are shown in FIGS. 2 and 3. As already explained hereinbefore, the purpose of the apparatus 30 is to convolute uniting bands (one shown in FIG. 3, as at 53) around the filter mouthpieces of double unit length as well as around the neighboring (inner) end portions of the respective filter cigarettes of unit length to thus convert the respective groups 52 into filter cigarettes 71 of double unit length. The conveyor 29 is driven by a suitable prime mover (not shown) to rotate about a horizontal axis 69 in the direction indicated by an arrow 63.

The illustrated conveyor 29 comprises a stationary core 57 surrounded by a cylindrical sleeve 56 which is driven to rotate in the direction of the arrow 63 and has an undulate peripheral rolling surface 62 including equidistant axially parallel receptacles or flutes 59 for discrete groups 52. The periphery of the stationary core 57 is provided with one or more circumferentially extending grooves 58 which are connected to the intake of a blower, pump or another suitable suction generating device, and the sleeve 56 is provided with radially extending suction ports 61 extending to the flutes 59 and serving to attract the groups 52 to those portions or sections of the peripheral rolling surface 62 which bound the respective flutes 59 while the flutes cover certain portions or stages of their orbital movement about the axis 69. Each flute 59 can be temporarily connected with the groove or grooves 58 by two or more axially spaced apart suction ports 61.

The rolling member 31 is mounted on a linkage 64 which can be actuated by a prime mover 66 (e.g., a pneumatically or hydraulically operated cylinder and piston unit) so as to move the rolling surface 54 of the member 31 to an optimum position relative to the peripheral rolling surface 62 of the sleeve 56 forming the rotary part or rotor of the group advancing conveyor 29. The linkage 64 can be designed to constitute a parallel motion mechanism which can move the member 31 radially of the conveyor 29 but without changing the orientation of the concave rolling surface 54 relative to the convex rolling surface 62.

In accordance with a feature of the invention, the rolling surfaces 54 and 62 have undulate profiles which conform to the non-circular outlines of the articles forming the groups 52 in the flutes 59 of the surface 62. The profiled surfaces 54 and 62 confront each other across an arcuate channel or passage 67 between the conveyor 29 and the rolling member 31. The width of the passage 67 varies in dependency on the configuration of the confronting surfaces 54, 62 as well as in dependency upon changes in the angular position of the sleeve 56 forming part of the conveyor 29. The configuration of the surfaces 54 and 62 is preferably such that, during advancement through the channel or passage 67 and simultaneous rotation about their respective longitudinal axes M (see FIG. 4), the axes M of successive groups 52 advance along an arcuate path 68 (indicated in FIG. 3 by a phantom line) having it center of curvature on or at least close to the axis 69 of the conveyor 29. In other words, the barycenter of each of a short or long series of groups 52 advancing through the passage 67 advances along a part circular path while the groups 52 roll on their way along the stationary rolling surface 54 of the member 31. Such rolling movement results in highly predictable convolution or winding of the uniting bands 53 around the respective filter rod sections of double unit length and the adjacent inner end portions of the respective pairs of filter cigarettes of unit length. In other words, the groups 52 are converted into filter cigarettes 71 of double unit length in a highly predictable manner irrespective of the number of successively rolled groups 52.

In order to facilitate the start of rolling movement of successive groups 52 relative to the surfaces 54 and 62, the apparatus 30 preferably further comprises an elongated strip-shaped stationary group-contacting member 72 which is located at the inlet of the passage 67 and extends substantially radially toward but short of the peripheral rolling surface 62 as well as in parallelism with the axis 69. The distance of the edge or tip of the member 72 from the surface 62 is selected in such a way that the edge or tip of this member compels successive groups 52 to leave their respective flutes 59 and to start the rolling step which results in the winding of uniting bands 53 around the respective filter rod sections and plain cigarettes in the above described manner, i.e., so that each such group is converted into a filter cigarette 71 of double unit length wherein the tube constituting the converted uniting band 53 establishes a reliable sealing connection between the end portions of the filter rod section and the adjacent end portions of the respective plain cigarettes.

The member 72 preferably performs an additional important, desirable and advantageous function, namely that of ensuring that the axes M of successive groups 52 are parallel to the axis 69 of the conveyor 29 not later than when the groups 52 reach the inlet of the passage 67. The locus of the edge of the member 72 relative to the stationary core 57 of the conveyor 29 is selected in such a way that such edge causes an oncoming group 52 to proceed with its rolling movement along the surfaces 54 and 62 at the exact instant or immediately after the connection between the channel (suction chamber) 58 and the respective ports 61 is interrupted so that the group 52 reaching the member 72 can readily roll along the surfaces 54, 62 because it is no longer attracted (by suction) to the surface portion bounding the respective flute 59. All this contributes to a more predictable rolling of the groups 52 and to the making of high-quality filter cigarettes 71 of double unit length wherein all of the rod-shaped constituents have a non-circular cross-sectional outline.

The illustrated stationary rolling surface 54 of the member 31 has a series of successive identical sections **54*a*, 54*b*, 54*c*, 54*d*, 54*e*, 54*f*, 54*g*, as seen in the direction of the arrow 63. The number of such identical sections can be reduced to a mere two or increased to eight or even more without departing from the spirit of the present invention. A group 52 which is caused to advance through the passage 67 from the inlet (at 54*a*) to the outlet (at 54*g*) is caused to turn about its axis M through 180° during rolling movement along any one of the successive sections 54***a* to 54*g*. Thus, if the number of sections of the rolling surface 54 is reduced to four, each group 52 is caused to roll twice about its axis M during movement from the inlet to the outlet of the passage 67. The number of complete revolutions or rolling movements of the groups 52 about their respective axes M is increased to three if the surface 54 includes the sections 54*a* to 54*f*. It has been found that repeated rolling of successive groups 52 between the stationary surface 54 and the advancing surface 62 reliably ensures complete winding of each uniting band 53 about the respective filter rod section of double unit length and the adjacent end portions of the corresponding plain cigarettes of unit length. A freshly obtained filter cigarette 71 of double unit length is immediately attracted to the surface bounding the nearest flute 59 because the corresponding port or ports 61 are again free to communicate with the suction chamber 58 in the periphery of the stationary core 57 forming part of the conveyor 29. The filter cigarettes 71 are attracted to the surface 62 until they reach the transfer station between the conveyors 29 and 32.

The enclosed Tables 1 and 2 furnish one specific example of the coordinates of the rolling surfaces 62 and 54 in a cartesian coordinate system including the X and Y axes (FIG. 2) crossing each other at the axis 69 of the conveyor 29. The information furnished by the Tables 1 and 2 has been selected for the rolling of uniting bands 53 around groups 52 having an elliptical cross-sectional outline matching or resembling that shown in FIG. 4, namely with a large diameter D=10 mm, a small diameter d=5.8 mm, with a large radius R=6.47 mm and with a small radius r=1.4 mm. The outline shown in FIG. 4 is greatly enlarged for the sake of clarity and not exactly to scale.

The Table 1 contains the X and Y coordinates of the undulate outline of the rolling surface 62. These coordinates furnish the positive direction, and the information provided by the Table 1 relates to that portion of the surface 62 which is located within the 10-degree angle shown in FIG. 2. Such portion or section of the surface 62 is repeated 36 times all the way around the sleeve 56 of the conveyor 29.

The Table 2 furnishes information relating to one-third of the undulate outline of the rolling surface 54 on the stationary rolling member 31, e.g., of the outlines of the sections 54*a* and 54*b* or 54*c*, 54*d*, and so forth. As already mentioned above, the surface 54 ensures that a group 52 advancing through the passage 67 is compelled to turn at least three times about its axis M before it reaches the outlet (at 54*g*) of the passage.

If the coordinate system of FIG. 2 is turned stepwise in a clockwise direction through 10-degree angles, the Tables 1 and 2 provide the coordinates X and Y for the entire peripheral rolling surface 62 as well as for the entire second rolling surface 54. The information furnished by the Tables 1 and 2 renders it possible to design the surfaces 54 and 62 in such a way that the axes M of successive groups 52 remain at the arcuate path 68 during advancement of the respective groups through the passage 67 all the way from the inlet (at 54*a*) to the outlet (at 54*g*) of such passage. This ensures gentle treatment of the components of the groups 52 during rolling of the uniting bands 53 around them, i.e., during conversion of the groups into filter cigarettes 71 of double unit length, even if the path of the axes M does not exactly coincide with the path 68.

The stationary member 72 constitutes an optional but desirable and advantageous feature of the apparatus 30 because it ensures proper orientation of successive groups 52 at the inlet of the passage 67 as well as timely start of rolling movement relative to the surfaces 54 and 62. All this contributes to more predictable operation of the apparatus 30 and the making of superior filter cigarettes 71.

An important advantage of the apparatus 30 is that it ensures the advancement and rolling of successive groups 52 in the passage 67 in such a way that the radial pressure upon the external surfaces of the groups during rolling relative to the surfaces 54 and 62 remains at least substantially constant which contributes significantly to the quality of the wrapping or convoluting action as well as to the appearance and other desirable characteristics of the filter cigarettes 71. Morevoer, by ensuring that the axes M of successive groups 52 advance along a path which at least approximates the arcuate path 68, one ensures that the movement of the groups through the passage 67 is a steady movement without any or without any appreciable radial and/or other stray movements. This too, contributes to the quality of the cigarettes 71 and renders it possible to advance successive groups 52 through the passage 67 at an elevated speed. The quality of the cigarettes 71 is further enhanced due to the fact that the dimensions of the surface 54 can be readily selected with a view to ensure repeated rolling of the groups 52 through angles of 360°, i.e., that each and every uniting band 53 is reliably and cleanly draped around the corresponding filter rod section of double unit length and the adjacent inner end portions of the respective plain cigaretes of unit length.

TABLE 1

| (Coordinates of the rolling surface 62) | | | | | |
|---|---|---|---|---|---|
| X | Y | X | Y | X | Y |
| 130.3500 | 0.0000 | 131.9402 | 7.5377 | 131,3404 | 16.1515 |
| 130.3810 | 0.3480 | 131.8499 | 7.7586 | 131.3546 | 16.3644 |
| 130.4759 | 0.6919 | 131.7484 | 7.9844 | 131.3604 | 16.5736 |
| 130.6415 | 1.0273 | 131.6353 | 8.2159 | 131.3581 | 16.7800 |
| 130.8421 | 1.3504 | 131.5097 | 8.4538 | 131.3477 | 16.9839 |
| 131.0281 | 1.6602 | 131.3711 | 8.6987 | 131.3293 | 17.1860 |
| 131.1996 | 1.9575 | 131.2189 | 8.9514 | 131.3029 | 17.3868 |
| 131.3566 | 2.2431 | 131.0524 | 9.2128 | 131.2683 | 17.5868 |
| 131.4998 | 2.5180 | 130.8710 | 9.4837 | 131.2256 | 17.7865 |
| 131.6294 | 2.7831 | 130.6743 | 9.7649 | 131.1745 | 17.9865 |
| 131.7461 | 3.0392 | 130.4620 | 10.0573 | 131.1146 | 18.1871 |
| 131.8504 | 3.2870 | 130.2340 | 10.3617 | 131.0458 | 18.3890 |
| 131.9430 | 3.5275 | 130.0398 | 10.6814 | 130.9677 | 18.5926 |
| 132.0244 | 3.7614 | 129.9153 | 11.0157 | 130.8797 | 18.7985 |
| 132.0951 | 3.9893 | 129.8541 | 11.3597 | 130.7813 | 19.0073 |
| 132.1557 | 4.2119 | 129.8546 | 11.7091 | 130.6721 | 19.2194 |
| 132.2066 | 4.4300 | 129.9192 | 12.0599 | 130.5514 | 19.4356 |
| 132.2483 | 4.6441 | 130.0549 | 12.4085 | 130.4184 | 19.6563 |
| 132.2810 | 4.8549 | 130.2267 | 12.7479 | 130.2726 | 19.8823 |
| 132.3050 | 5.0628 | 130.3850 | 13.0727 | 130.1133 | 20.1143 |
| 132.3207 | 5.2686 | 130.5298 | 13.3837 | 129.9396 | 20.3528 |
| 132.3281 | 5.4727 | 130.6614 | 13.6820 | 129.7509 | 20.5987 |
| 132.3274 | 5.6756 | 130.7800 | 13.9683 | 129.5466 | 20.8527 |
| 132.3185 | 5.8780 | 130.8861 | 14.2437 | 129.3262 | 21.1157 |
| 132.3016 | 6.0802 | 130.9800 | 14.5090 | 129.0892 | 21.3884 |
| 132.2764 | 6.2829 | 131.0623 | 14.7650 | 128.8355 | 21.6719 |
| 132.2429 | 6.4865 | 131.1336 | 15.0126 | 128.6142 | 21.9734 |
| 132.2008 | 6.6916 | 131.1943 | 15.2526 | 128.4610 | 22.2956 |
| 132.1498 | 6.8987 | 131.2449 | 15.4858 | 128.3701 | 22.6329 |
| 132.0897 | 7.1084 | 131.2859 | 15.7129 | | |
| 132.0200 | 7.3212 | 131.3176 | 15.9346 | | |

TABLE 2

| (Coordinates of the rolling surface 54) | | | | | |
|---|---|---|---|---|---|
| X | Y | X | Y | X | Y |
| 139.9500 | 0.0000 | 137.9413 | 7.4930 | 137.1171 | 15.7541 |
| 139.9181 | 0.3479 | 138.0061 | 7.7227 | 137.0441 | 15.9596 |

TABLE 2-continued

| (Coordinates of the rolling surface 54) | | | | | |
|---|---|---|---|---|---|
| X | Y | X | Y | X | Y |
| 139.8205 | 0.6911 | 138.0807 | 7.9588 | 136.9797 | 16.1630 |
| 139.6507 | 1.0243 | 138.1653 | 8.2021 | 136.9237 | 16.3647 |
| 139.4444 | 1.3439 | 138.2607 | 8.4536 | 136.8757 | 16.5654 |
| 139.2516 | 1.6495 | 138.3671 | 8.7141 | 136.8355 | 16.7656 |
| 139.0723 | 1.9420 | 138.4850 | 8.9846 | 136.8030 | 16.9660 |
| 138.9064 | 2.2227 | 138.6148 | 9.2660 | 136.7779 | 17.1669 |
| 138.7538 | 2.4924 | 138.7569 | 9.5594 | 136.7602 | 17.3691 |
| 138.6139 | 2.7522 | 138.9114 | 9.8658 | 136.7500 | 17.5731 |
| 138.4863 | 3.0030 | 139.0784 | 10.1863 | 136.7472 | 17.7794 |
| 138.3705 | 3.2458 | 139.2575 | 10.5218 | 136.7519 | 17.9887 |
| 138.2660 | 3.4813 | 139.3992 | 10.8680 | 136.7643 | 18.2016 |
| 138.1722 | 3.7015 | 139.4681 | 11.2180 | 136.7847 | 18.4188 |
| 138.0886 | 3.9340 | 139.4711 | 11.5674 | 136.8131 | 18.6409 |
| 138.0147 | 4.1526 | 139.4106 | 11.9115 | 136.8500 | 18.8687 |
| 137.9501 | 4.3670 | 139.2850 | 12.2454 | 136.8956 | 19.1029 |
| 137.8943 | 4.5778 | 139.0882 | 12.5635 | 136.9504 | 19.3444 |
| 137.8469 | 4.7858 | 138.8562 | 12.8649 | 137.0147 | 19.5939 |
| 137.8078 | 4.9915 | 138.6388 | 13.1535 | 137.0889 | 19.8524 |
| 137.7765 | 5.1955 | 138.4359 | 13.4302 | 137.1734 | 20.1209 |
| 137.7531 | 5.3983 | 138.2474 | 13.6962 | 137.2685 | 20.4002 |
| 137.7372 | 5.6006 | 138.0730 | 13.9524 | 137.3747 | 20.6914 |
| 137.7288 | 5.8030 | 137.9121 | 14.1997 | 137.4920 | 20.9955 |
| 137.7279 | 6.0059 | 137.7642 | 14.4392 | 137.6207 | 21.3136 |
| 137.7345 | 6.2101 | 137.6288 | 14.6715 | 137.7606 | 21.6467 |
| 137.7488 | 6.4159 | 137.5052 | 14.8976 | 137.9114 | 21.9960 |
| 137.7708 | 6.6241 | 137.3928 | 15.1182 | 138.0240 | 22.3526 |
| 137.8008 | 6.8353 | 137.2910 | 15.3340 | 138.0637 | 22.7072 |
| 137.8390 | 7.0500 | 137.1993 | 15.5458 | 138.0378 | 23.0556 |
| 137.8857 | 7.2690 | | | | |

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of making rod-shaped smokers' products and, therefore, such adaptations should and are intended to be comprehended within the meaning and range of equivalence of the appended claims.

What is claimed is:

1. Apparatus for connecting groups of aligned rod-shaped smokers' articles, having non-circular cross-sectional outlines and including neighboring end portions, by adherent uniting bands which are carried by and are to be convoluted around the neighboring end portions of the articles, comprising a group advancing conveyor rotatable in a predetermined direction about a predetermined axis and having a peripheral rolling surface provided with axially parallel group-receiving flutes, said peripheral surface having a first undulate profile conforming to the outlines of the articles forming said groups; and a rolling member adjacent to and defining with said conveyor a passage wherein the uniting bands carried by the groups are convoluted about the end portions of the respective articles as a result of rolling of the articles along said peripheral surface, said rolling member including a second rolling surface confronting said peripheral rolling surface across said passage and having a second undulate profile also conforming to the outlines of the articles forming said groups.

2. The apparatus of claim 1, wherein said surfaces include portions having substantially elliptical profiles.

3. The apparatus of claim 1, wherein the groups of articles being advanced by said conveyor have axes which are at least substantially parallel to said predetermined axis and the profiles of said surfaces are such that the axes of the groups being advanced through said passage move along an arcuate path having a center of curvature at said predetermined axis.

4. The apparatus of claim 3, wherein one of said rolling surfaces is substantially concave and the other of said rolling surfaces is substantially convex.

5. The apparatus of claim 1, wherein said second rolling surface includes a plurality of sections which follow each other in said predetermined direction and have at least substantially identical portions of said second profile.

6. The apparatus of claim 5, wherein said second surface includes at least three sections.

7. The apparatus of claim 1, wherein said passage has an inlet and an outlet, as seen in said predetermined direction, and further comprising a group contacting member disposed at said inlet and extending toward but short of said peripheral rolling surface to set in rolling motion, relative to said peripheral rolling surface, the groups of articles being received in said flutes and being advanced toward said passage.

8. The apparatus of claim 7, wherein said group contacting member is stationary and extends substantially radially of as well as in substantial parallelism with said predetermined axis.

9. The apparatus of claim 7, wherein said group contacting member includes means for aligning successive groups with said predetermined axis not later than upon entry of the groups into said passage by way of said inlet.

* * * * *